United States Patent [19]

Hevesi

[11] Patent Number: 4,943,753

[45] Date of Patent: Jul. 24, 1990

[54] MAGNETIC SHUNT FOR DEFLECTION YOKES

[75] Inventor: Joseph F. Hevesi, West Hurley, N.Y.

[73] Assignee: International Business Machines Corporation, Armonk, N.Y.

[21] Appl. No.: 265,115

[22] Filed: Oct. 31, 1988

Related U.S. Application Data

[63] Continuation-in-part of Ser. No. 84,949, Aug. 13, 1987, abandoned.

[51] Int. Cl.[5] ..... H01J 29/70; H01H 5/00

[52] U.S. Cl. ..... 313/440; 335/214

[58] Field of Search ..... 313/440; 358/248, 249; 335/210, 211, 214

[56] References Cited

U.S. PATENT DOCUMENTS

| | | | |
|---|---|---|---|
| Re. 29,895 | 1/1979 | Murata et al. | 313/411 |
| 2,605,433 | 7/1952 | Friend | 313/76 |
| 3,246,192 | 4/1966 | Torsch | 313/76 |
| 3,573,525 | 4/1971 | Fuse | 313/75 |
| 4,433,268 | 2/1984 | Arisato | 313/440 |
| 4,471,261 | 9/1984 | Meier et al. | 313/440 |
| 4,556,857 | 12/1985 | Logan | 335/210 |

FOREIGN PATENT DOCUMENTS

| | | | |
|---|---|---|---|
| 2658729 | 6/1978 | Fed. Rep. of Germany . | |
| 861458 | 4/1986 | Finland . | |
| 0022817 | 2/1977 | Japan | 313/440 |
| 0006357 | 1/1981 | Japan | 313/440 |
| 0191238 | 10/1984 | Japan | 313/440 |
| 0148037 | 8/1985 | Japan | 313/440 |
| 0189845 | 9/1985 | Japan | 313/440 |

OTHER PUBLICATIONS

Design of a Ns-Pin Corrected 110° Coty Yokes for CRTs with Very Flat Faceplates, B. B. Dasgupta, SID-12-87, Digest, pp. 332-334.

The Radiating Fields of Magnetic Deflection Systems and Their Compensation, A. A. Sluyterman, 12-1987, SID Proceedings.

*Primary Examiner*—Sandra O'Shea

*Attorney, Agent, or Firm*—Robert L. Troike

[57] ABSTRACT

Apparatus for reducing net distributed magnetic radiation in front of and all about the outside of a cathode ray tube display device. In such cathode ray apparatus a deflection coil is provided having axially aligned and circumferentially aligned wire segments, relative to the central axis thereof, producing a distributed magnetic field in front of the screen as well as all about the outside of the device which is undesirable. The invention provides a magnetic shunt disposed between the deflection coil and the screen, the shunt comprising a substantially ring-shaped arrangement of magnetically permeable material having its configuration and position relative to the coil optimized to maximize cancellation of the net distributed magnetic field as a selected point in space in front of said screen as well as all about the display device, so as to provide optimized overall magnetic field reduction through the action of the shunt.

11 Claims, 13 Drawing Sheets

MAGNETIC SHUNT FOR DEFLECTION YOKES

This is a continuation-in-part of application Ser. No. 07/084,949 filed Aug. 13, 1987 now abandoned.

BACKGROUND OF THE INVENTION

1. Field of the Invention

The present invention relates to display apparatus, and more particularly relates to apparatus for reducing unwanted magnetic radiation external to a cathode ray tube display device without affecting the intended deflection field within the bore of the yoke.

2. Background Art

Cathode Ray Tubes ("CRTs") generally have associated coils, or yokes, to provide a varying magnetic field for electron beam deflection, for example for raster scan. In addition to manifesting itself within the CRT, for beam deflection, this magnetic field also extends around the outside of the CRT and beyond the display device. This external magnetic field serves not useful purpose and an effort is frequently made to reduce this part of the yoke magnetic field. In particular the unwanted frequency range is from 1K to 350K hertz (VLF).

A. A. Seyno Sluyterman of Phillips describes the radiated field due to the horizontal deflection system in his paper entitled "The Radiating Fields of Magnetic Deflection Systems and Their Compensation" presented in 1987 SID Society of Information Display Proceedings. In that paper it shows that the radiated field of the horizontal magnetic circuit of the yoke at mid-range, resembles a vertically oriented dipole, whose mathematical center lies on the long axis slightly ahead of the yoke, Means to provide reduction of this radiation are proposed in this paper. In one case the Helmholtz coils are "on top" and "below" the saddle-shaped deflection yoke. In another case the Helmholtz coils are behind the yoke. The coils are coupled to the deflection coils and the EMF is induced therein, giving rise to a magnetic field which tends to cancel the unwanted radiated magnetic field. However, this is a relatively expensive and bulky solution to the problem. A similar top and bottom coil configuration is in published Finnish Patent Application No. 861458, Apr. 4, 1986 of Nokia.

Another proposed solution is the placement of shielding all around the CRT, which results in magnetic radiation reduction from the eddy currents induced in the shielding. However, this is also an expensive solution to the problem, and results in only minimal reduction in the magnetic field in front of the screen.

Accordingly, there is a need for means to reduce to acceptable levels the residual magnetic field in front of the cathode ray tube display device that provides an inexpensive and compact solution to the problem.

SUMMARY OF THE INVENTION

The present invention finds application in a cathode ray apparatus including a cathode ray tube ("CRT") having a screen for viewing and having a charged particle beam directed at the screen from the rear thereof and aligned with the central axis of the tube, but that may be magnetically deflected from the axis, and having a deflection coil producing a magnetic component from axially aligned wire segments and a magnetic component from circumferentially aligned wire segments relative to the axis, giving rise to a net distributed magnetic field in about the coil. The apparatus reduces the net distributed magnetic radiation all about the coil through the provision of a ring disposed between the coil and the screen, wherein the ring is of magnetically permeable material having its configuration and position relative to the coil selected to minimize the net distributed magnetic field in front of the coil.

The invention may be embodied in forms which are made of relatively inexpensive linear ferrite materials configured in shapes that are inexpensive to provide, such as a flat ring or the like. As such, it permits a relatively inexpensive solution to the problem. In addition, in tested embodiments the present invention has demonstrated dramatic reductions in the unwanted radiation in front of CRTs to which it has been applied.

The foregoing and other objects, features and advantages of the invention will be apparent from the more particular description of the preferred embodiments of the invention, as illustrated in the accompanying drawings.

DETAILED DESCRIPTION OF EMBODIMENTS

Figure 1:
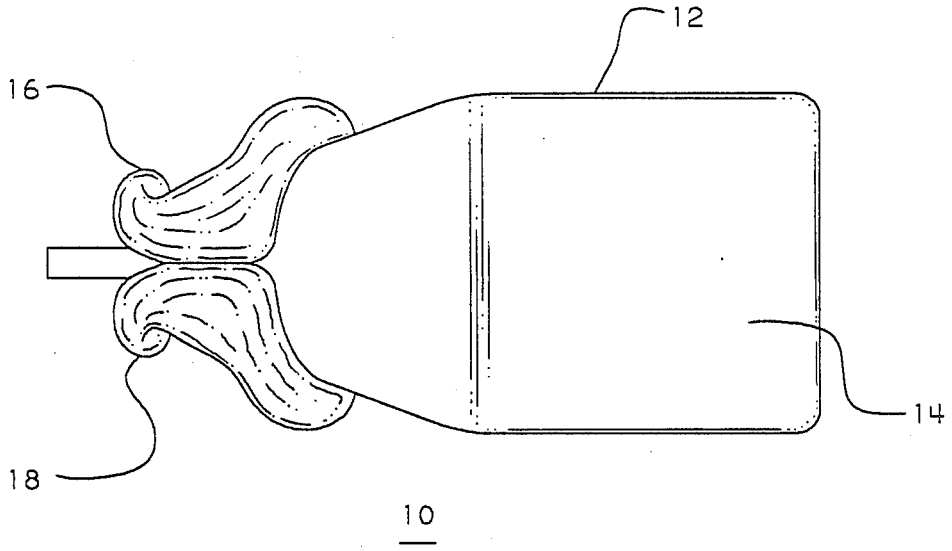
FIG. 1 is a diagram showing pertinent portions of an integrated air core yoke tube component.

FIG. 1 shows the pertinent portions of an integrated yoke tube component ("ITC") 10 which includes CRT 12, having a front screen 14, and upper and lower horizontal deflection coils 16, 18. The deflection coils 16, 18 generate a varying magnetic field between them, inside CRT 12, to deflect the electron beam within the tube 12 for horizontal sweeping across the fact of the screen 14, as is well known in the art.

Figure 2:
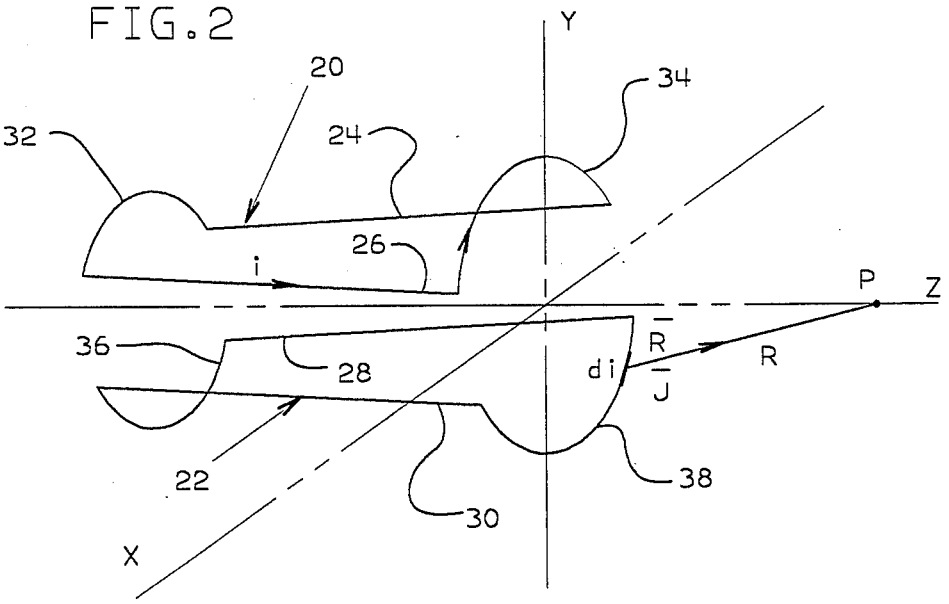
FIG. 2 is a simplified diagram of one winding each from the upper and lower horizontal deflection coils of the integrated yoke tube component shown in FIG. 1.

FIG. 2 is a simplified diagram of one winding each from the upper and lower deflection coils 16, 18 of FIG. 1. Thus, loop 20 is a single loop from coil 16, while loop 22 is a single loop from coil 18. As illustrated, a current i flows through each of the coils so as to generate the above described varying magnetic field for horizontal deflection of the electron beam.

In FIG. 2, X, Y, and Z axes are depicted, having their origin in the plane of circumferential coil portions 34, 38 and centrally located between them. The X axis coincides with the central axis of CRT 12 (FIG. 1). Note that the upper and lower halves 20, 22 are symmetrical about the x–z and y–z planes.

In actual operation the upper and lower loops 20, 22 are interconnected to produce a dipole field on the Z axis as is known. From the known coil shape and current, the $\overline{B}$ field is given by:

$$B = \frac{\mu}{4\pi} \int \frac{J \times R}{R^2} dl$$

where $\overline{J}$ is the current, $\overline{R}$is the direction and R is the distance to a point of interest T on the Z axis. This equation is used in computing the field distribution of FIGS. 3 and 7 through 12.

Figure 3:
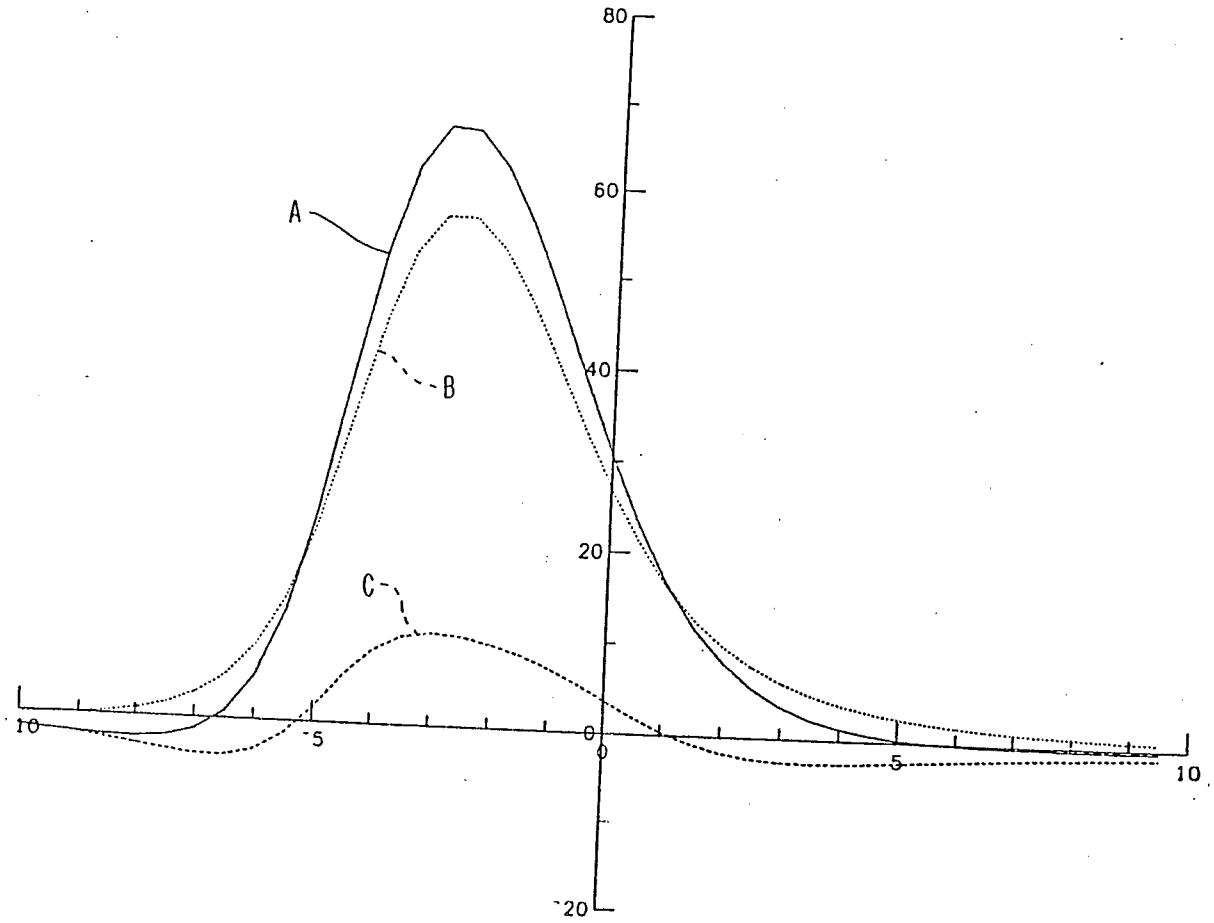
FIG. 3 is a computed plot showing the magnetic field intensity along the Z axis for a typical deflection yoke such as is shown in FIG. 1.

A plot of the computed $\overline{B}$ field distribution of an air core horizontal deflection coil, such as is shown in FIG. 1, without any high permeability material, like ferrite shielding, is shown in FIG. 3. The actual $\overline{B}$ field is a directional field, and the plot shown in FIG. 3 shows only the magnitude, or intensity, of such magnetic field along the Z axis. The units depicted on the horizontal axis are centimeters, while the units in the vertical axis are gauss. The curve reflects a typical coil having current flowing so as to produce a field which deflects a 20 kilovolt electron beam to an angle of about 40 degrees.

Curves A, B, and C of FIG. 3 represent the total field, the partial field from the axial wires and the partial field from the end turns, respectively. Curve A is the magnitude of the vector sum of the fields represented by curves B and C. In typical uncompensated yokes, at 55 centimeters in front of the yoke the field can be in range of approximately 1,000–2,000 nano-Tesla. Clearly, this is not very large magnetic field. However, in accordance with the present invention this field can be reduced to an even smaller quantity. In actual experiments using the preferred embodiment described below, reductions to below 200 nano-tesla at 55 centimeters was measured.

Figure 4:
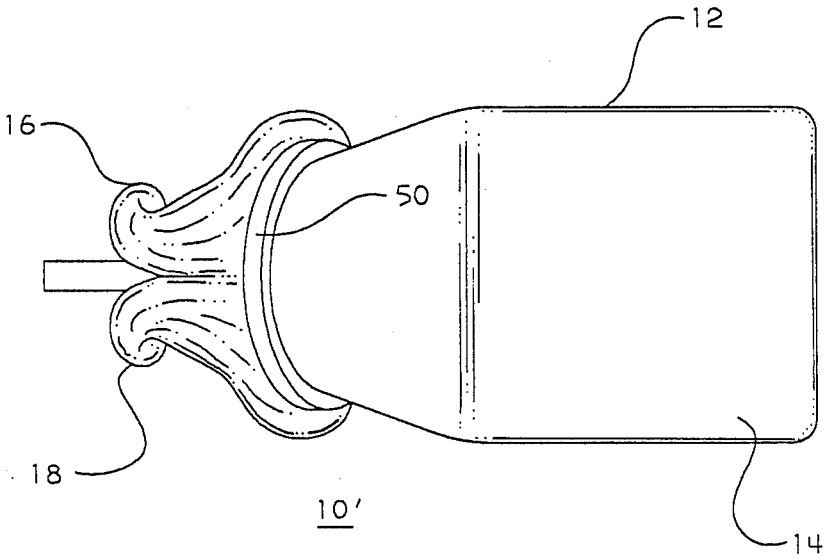
FIG. 4 is a figure like that of FIG. 1, having added thereto a ring 50 in accordance with the preferred embodiment of the present invention.

FIG. 4 shows the ITC 10 of FIG. 1 having added thereto a ring 50 of linear ferrite operating as a magnetic shunt, in accordance with one embodiment of the present invention.

Figure 5:
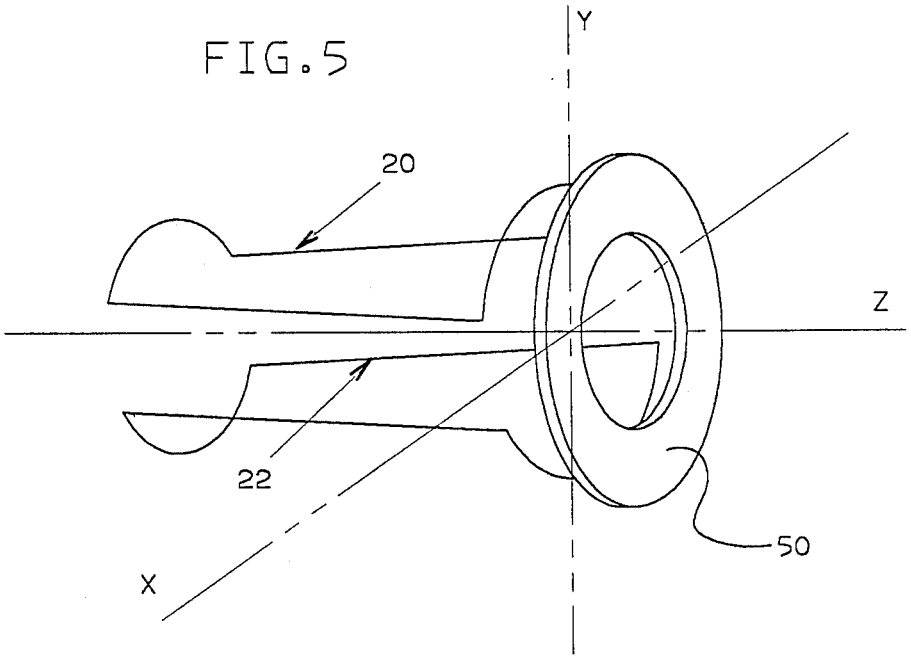
FIG. 5 is a diagram like that of FIG. 2, having added thereto a ring 50 in accordance with the preferred embodiment of the present invention.

FIG. 5 shows the loops 20, 22 of FIG. 2, with the ferrite ring 50 disposed in front of it, to illustrate the relative shape and position of ring 50.

Ring 50, as mentioned above, is a linear ferrite. Linear ferrite is a well known material commonly used in transformer and yoke production. According to the preferred embodiment the ring 50 has a relatively high magnetic permeability, ($\mu$ above 2,500). It also has a high volume resistivity, for example 1 Meg Ohm or more per cubic centimeter. The high resistivity value keeps eddy currents at a minimum. Otherwise the loading effects on the yoke would result in a need for more energy to drive the yoke. While embodiments could be constructed, for example out of conventional $\mu$ laminates, having this loading effect, and be in accordance with the present invention, it was deemed desirable to keep the eddy currents low, and avoid this loading effect in the preferred embodiment. The cross section of the ring 50 is large enough to avoid saturation.

Figure 6:
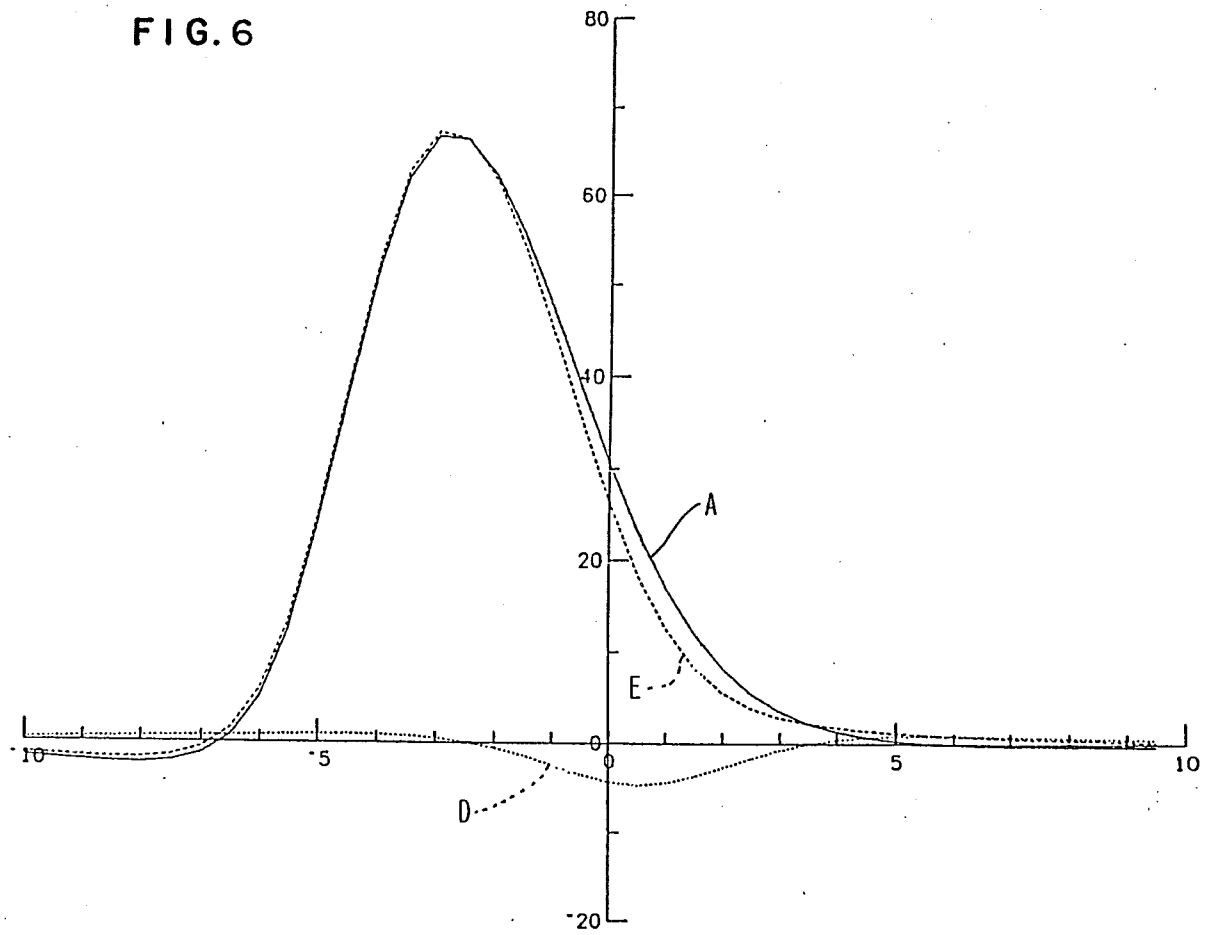
FIG. 6 is a set of curves, on the same set of axes as in FIG. 3, showing the effect on the net field A of ring 50.

FIG. 6 is a set of curves, on the same set of axes as those of FIG. 3, showing the effect on the net field A shown in FIG. 3 of a flat ring, such as ring 50 in FIG. 4, in accordance with the preferred embodiment of the present invention. Curve A in FIG. 6 is the same as curve A in FIG. 3. Curve D in FIG. 6 represents the field contribution from the magnetization effect of the ring 50, while curve E represents the resultant curve from the combination of curves A and D.

Figure 7:
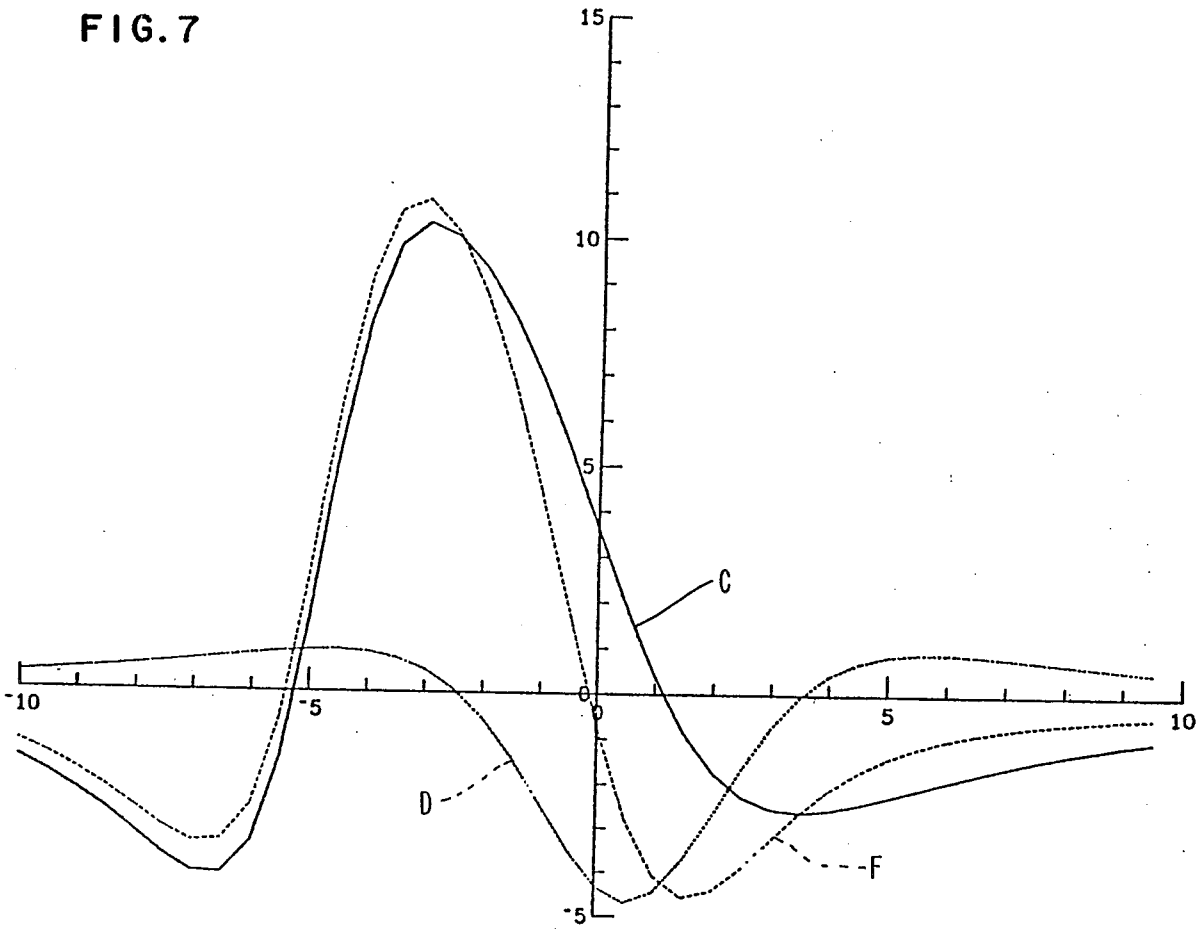
FIG. 7 is a set of curves showing the effect of ring 50 on the end turn field shown in FIG. 3.

To better understand the effect of field D on the overall magnetic field A, a set of curves is shown in FIG. 7 including curve D, and the end turn magnetic field component C. Curve C is the same curve C as shown in FIG. 3. Curve F is a curve representing the resultant field from the combination of curves D and C. Note that in FIG. 7 the horizontal axis is the same in FIGS. 3 and 7 while the vertical scale has been expanded, to aid in clarity.

As mentioned above, curve D is the theoretical field of the ring alone. This is an intrinsic field which is created by the magnetization force of the end turn field. It should be noted that the presence of the ring attenuates the end turn field. The degree of attenuation is controlled by the variables such as ring dimensions and ring yoke separation, as is discussed in more detail below. It should be further noted that the end turn field combines with the main deflection field, and the area in front of the CRT screen, to form the net measurable residual field whose reduction is an object of this invention. At optimum attenuation, the modified end turn field F is equal it magnitude but opposite in direction to the main deflection field, resulting in a zero vector sum. As a practical matter, the net measurable residual field in front of the CRT screen can never be reduced to zero. However, by application of the principles of the present invention as disclosed herein, this field can be reduced to very small levels.

Figure 8:
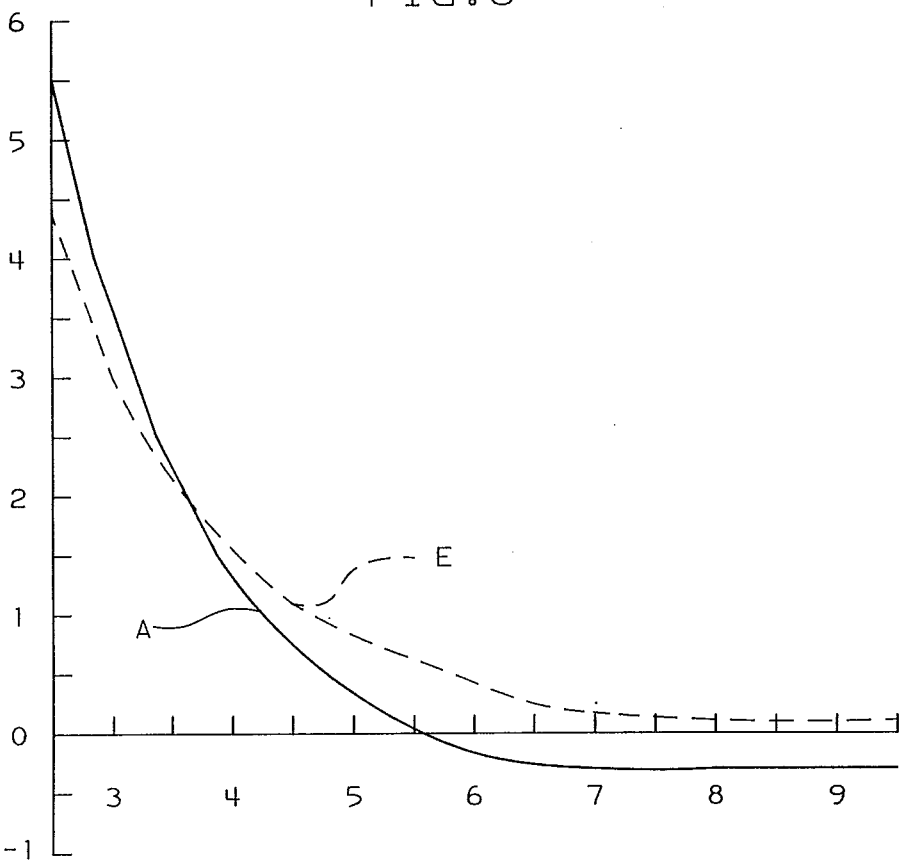
FIG. 8 is an expanded view of the portion of the curve shown in FIG. 6 beyond approximately 2.5 centimeters.

The portion of FIG. 6 beyond approximately 2.5 centimeters to the right thereof is shown in FIG. 8. In order to see clearly the curve behavior in that region, the scale is expanded in the vertical direction as compared with FIG. 6. Curves A and E are described in FIG. 6. Curve D is not shown in this figure in the interest of providing more clarity for curves A and E. Note that Curve E is very nearly at a zero field magnitude at approximately 9.5 centimeters.

The compensated curve E is for a typical CRT-yoke configuration, having a ring 50 of ferrite with a 30 permeability of 1,000–3,000, and high volume resistivity, and having an inner dimension of 4 centimeters, a thickness of 0.2 centimeters, a width of 1 centimeter, placed at a distance of 0.4 centimeters from the end of the yoke. As used herein, the width of the ring refers to its radial extent from inner diameter to outer diameter.

Figure 9:
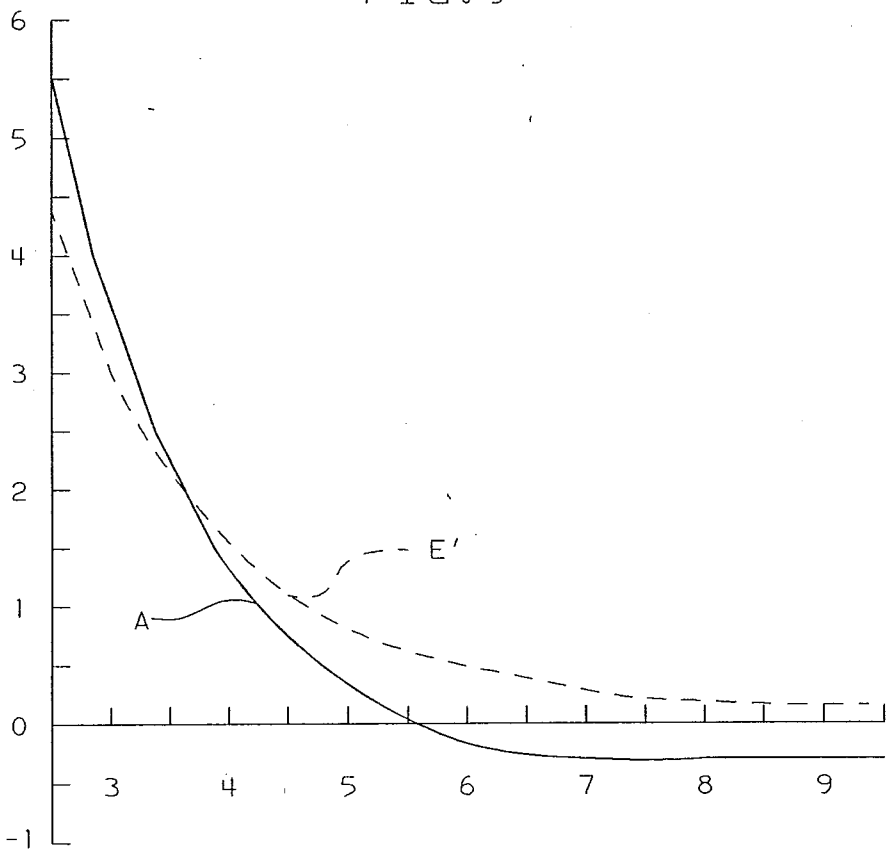
FIG. 9 is a plot like that of FIG. 8, wherein ring 50 is a slightly different distance from the yoke.
Figure 10:
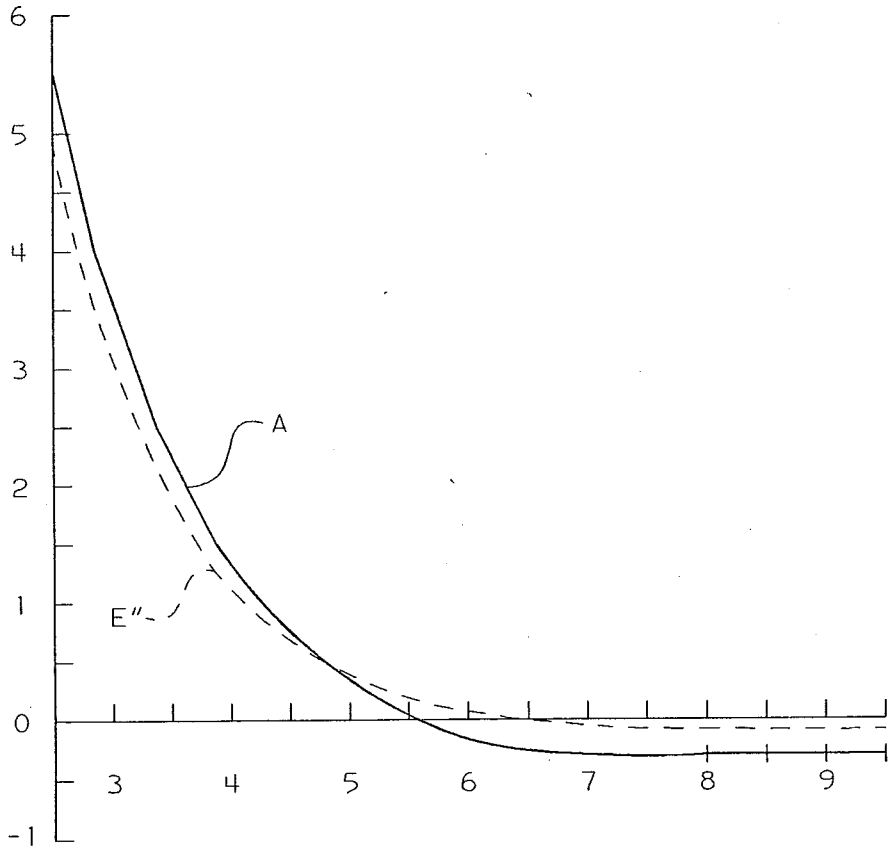
FIG. 10 is a diagram like FIG. 8, in which the inner diameter radius of ring 50 is slightly different from that of FIG. 8.
Figure 11:
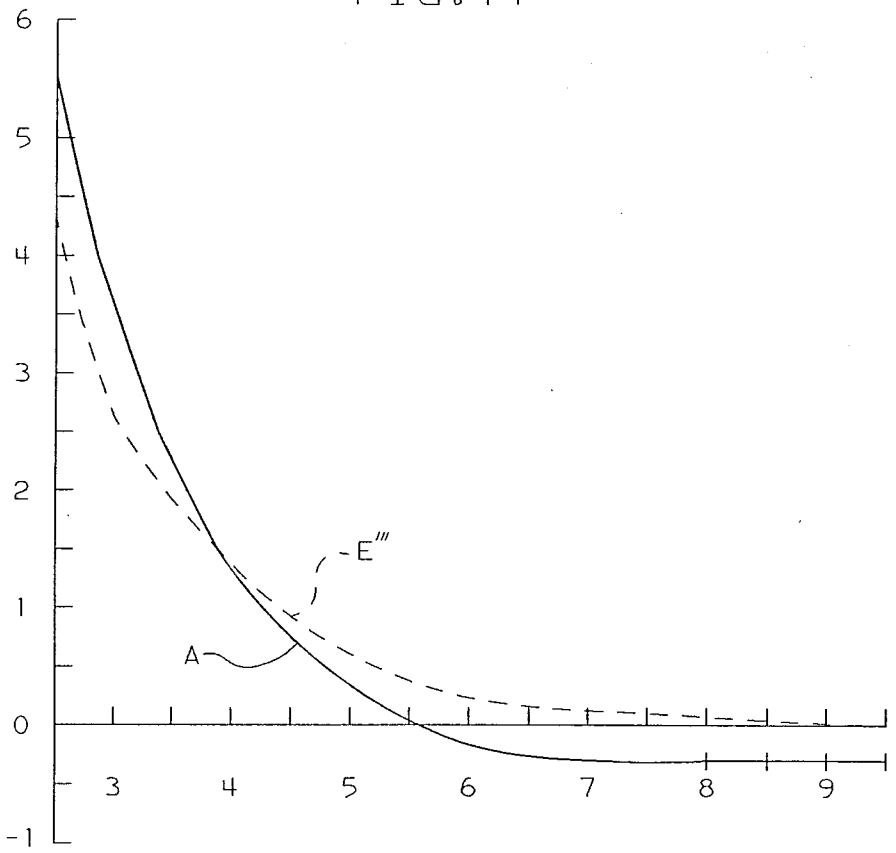
FIG. 11 is a curve like that of FIG. 8, but wherein the distance of the ring 50 from the end of the yoke is different from that of FIG. 8 and FIG. 9.

FIGS. 9–11 are plots like the plot shown in FIG. 8, for slightly different ring configurations from the configuration producing the curves of FIG. 8. Thus, in FIG. 9 all of the parameters for the ring are the same as those corresponding to FIG. 8, except the distance of the ring from the end of the yoke. In FIG. 9 the curves correspond to a configuration in which this dimension is 0.3 centimeters. It will be appreciated that this reveals over-compensation, as the curve E′ is slightly above the horizontal axis, for example of 9.5 centimeters and slightly below curve E in FIG. 8.

The curves of FIG. 10 are for a configuration in which the dimensions are the same as those corresponding to FIG. 8, but wherein the inner diameter radius is 5 centimeters, instead of 4 centimeters. It can be seen that significantly less compensation is provided, as curve E″ is here below the horizontal axis.

FIG. 11 shows a curve for a configuration wherein the dimensions are as in FIG. 8, but wherein the distance of the ring from the end of the yoke is 0.6 centimeters, instead of 0.4 centimeters. It can be seen that slightly less compensation is provided, causing curve E‴ to cross the horizontal axis of 9.5 centimeters. This was deemed to represent optimum compensation.

While curves are not provided showing the effect of change of width of the ring on the compensation effect, in general, decreasing the width will tend to reduce the compensating effect, while increasing the width will tend to increase the effect.

Thus, from the above FIGS. 8–11 it will be appreciated how changing the various dimensional parameters of the preferred embodiment of the present invention affects the performance of the ring in compensating by cancelling the magnetic field components on the X axis in front of the screen due to yoke winding and components. Through an understanding of these effects, one practicing the present invention can provide the adjustments deemed desirable to optimize the cancellation affect.

Figure 12:
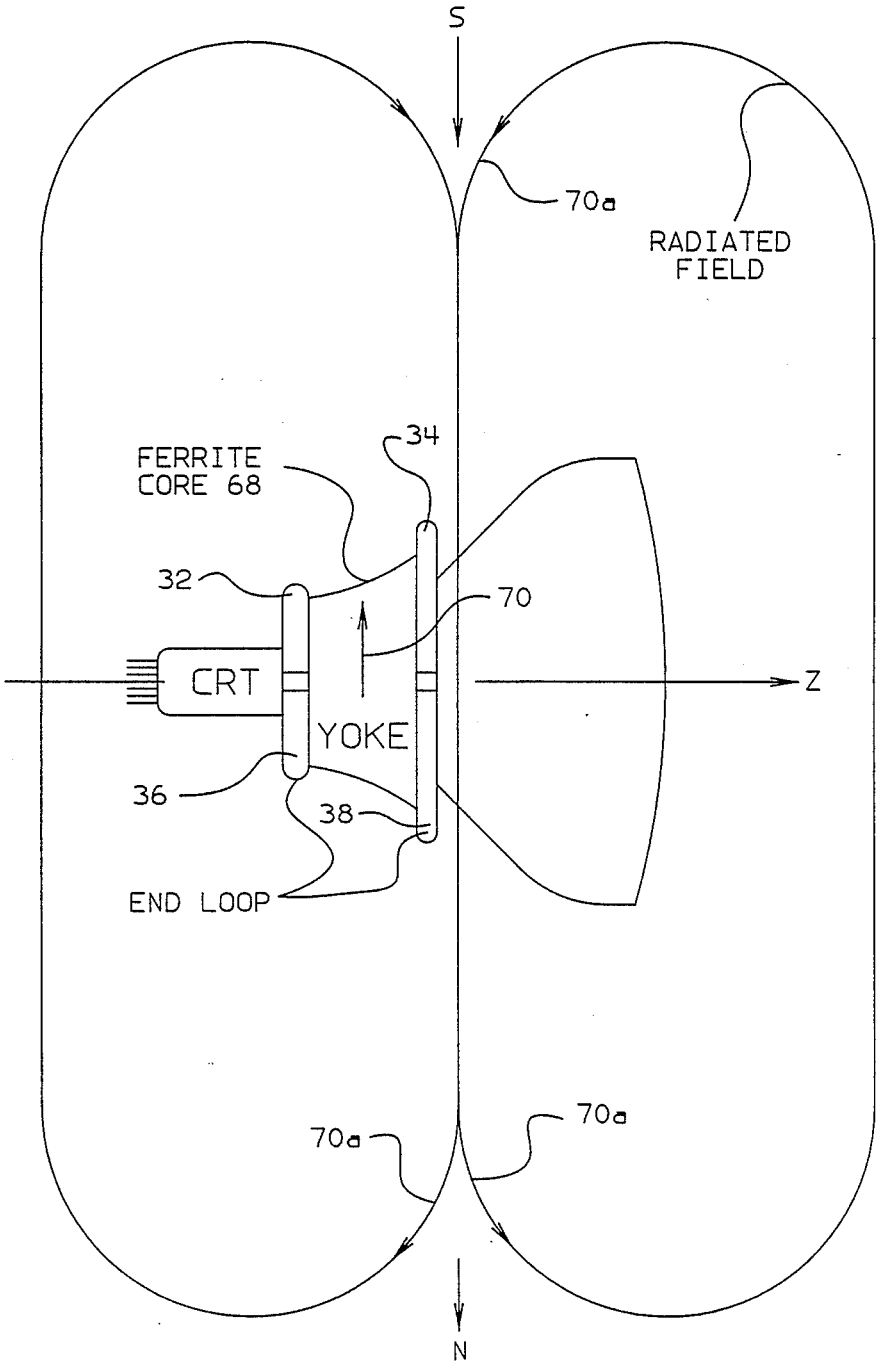
FIG. 12 is a diagram showing a CRT with yoke with a ferrite core and the associated fields.
Figure 13:
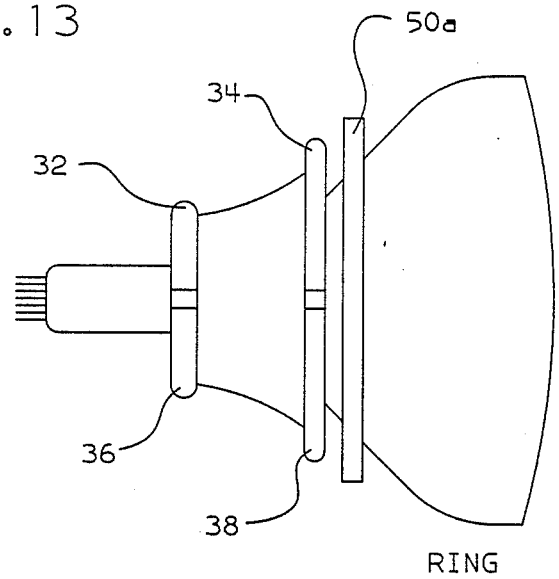
FIG. 13 illustrates the system of FIG. 12 with the compensating ring.
Figure 14:
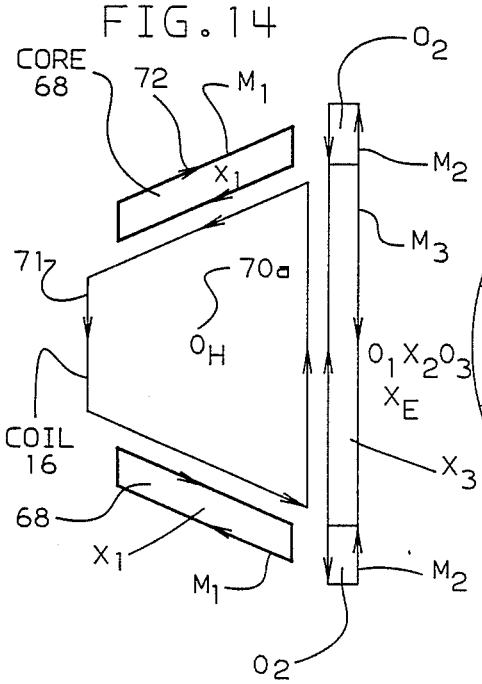
FIG. 14 is a sketch of the top view of the core, coil and ring of FIG. 13 illustrating magnetization currents and fields.
Figure 15:
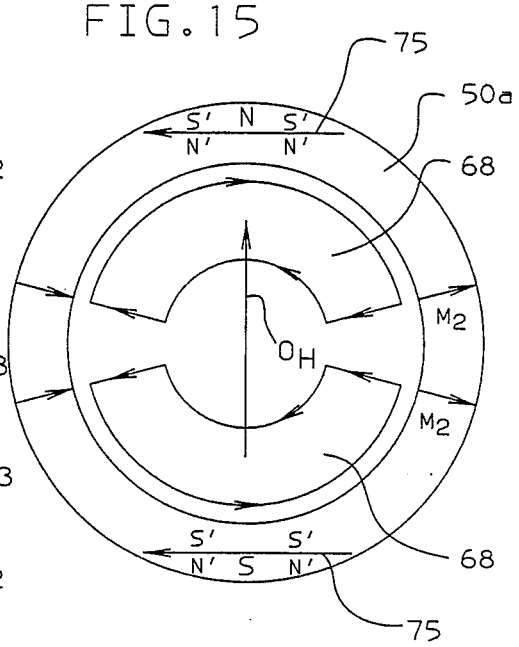
FIG. 15 is a sketch of the front view illustrating magnetization currents and fields.

In the above described arrangement the CRT tube has an air core horizontal deflection coil without any high permeability shielding about the neck of the tube. The direction of the horizontal deflection field to move the beam toward the right edge of the screen as viewed from the front is represented by arrow 70 in FIG. 12. In common commercial type yokes the horizontal deflection coils have ferrite shielding (ferrite core) 68 about the horizontal deflection coils as shown in FIG. 12. There is also vertical deflection coils (not shown) about the horizontal deflection coils and under the ferrite core. The radiated field produced by the horizontal coils with the end loops 32, 34, 36 and 38 extending beyond the ferrite core is a dipole centered forward of the loop nearest the screen as shown by arrows **70*a* in FIG. 12. Note the ferrite core reverses the polarity of the radiated field. A ferrite ring 50*a* as shown and illustrated in FIG. 13 is mounted forward of the horizontal deflection coil near the radiation center of the horizontal coil. The manner in which this ring compensates for the field radiation without measurably affecting the deflection is illustrated in connection with FIGS. 14 and 15. FIG. 14 is a sketch of the top view of the coil 16, core 68 and ring 50*a* illustrating the deflection current in the deflection coil, the magnetization currents and the resulting fields. FIG. 15 is a front view of FIG. 14. The counterclockwise current of the horizontal deflection coil seen in the top view is represented by 71. The magnetic field produced is represented by $O_H$ at the center that points toward the viewer. This corresponds to 70 in FIG. 12. The ferrite core 68 is coupled to the deflection coil and produces an even stronger equivalent magnetization current $M_1$ represented by the heavy lines 72. The coupled current 72 circulates in the opposite direction (clockwise in FIG. 14) with current along adjacent surfaces of coil and core flowing in the same direction. The result is a magnetic field $X_1$ (with a direction into the paper) in the center of the core and $O_1$ (with a direction out of the paper) in front of the ring. The field $X_1$ combines with field $O_H$ and produces a net radiated field $O_1$ or 70*a* of FIG. 12** which is the vector sum of $O_H$ and $X_1$. The radiated field $O_1$ is a dipole field and is the major component of the magnetic radiation. The exposed end-turns are radiating a minor quadrapole field which is designated with $X_e$. Symbols "X's" and "O's" are consistent with the sign convention established earlier where X means the field is pointing down into the paper, O means the field is pointing up toward the viewer. The sum $X_1$ and $X_e$ is the total radiated field without the presence of the ring.

When a ferrite ring is placed in front of the yoke as illustrated in FIGS. 13 and 14 the ring will be magnetized as described below. Magnetization currents $M_1$ in the yoke shield induce equivalent magnetization current $M_2$ in the ring in the counter clockwise directions. The resulting field is pointing up within the ring ($O_2$) and pointing down outside of the ring ($X_2$). The polarization of this field is also indicated in FIG. 15 with "N" (north) on top and "S" (south) on the bottom of the ring. The front end-turns of the horizontal coils (top, bottom) induce equivalent magnetization currents $M_3$ in the ring in a clockwise direction. The resulting field $X_3$ is pointing down within the ring and pointing up outside of the ring $O_3$. The polarization of this field is also shown in FIG. 15 with letters "N‴" (north) and "S‴" (south). From the distribution and polarization of the induced magnetization current end fields we conclude that the radiated field of the yoke shield $X_1$ sets up a dipole magnetization $O_2$ in the ring which opposes the radiating dipole. Similarly, the quadrapole component of the radiated field due to the exposed end-turns of the horizontal deflection coils induce a quadrapole magnetization in the ring which cancels the radiating quadrapole. Variables such as ring thickness, inside diameter, outside diameter, permeability and yoke-ring separation can be used to tune for optimum performance. Naturally, the lower limit of the ring dimensions are dictated by the given CRT and yoke combination. In practice, the tendency is to bring the ring as close to the front of the yoke as possible without adversely effecting the deflection field in the bore of the tube. This reduces the ring dimensions and assures minimum cost. The ring has the lower limit of permeability of about 1,000 with the ring placed closest to the yoke. The higher the permeability the greater the distance the ring can be from the yoke.

Figure 17:
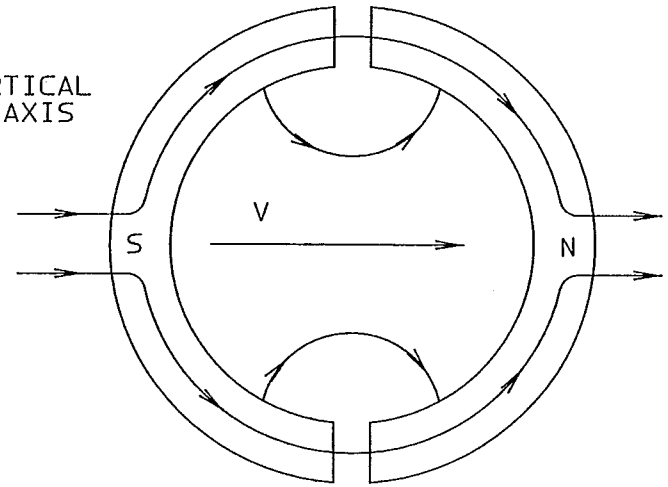
FIG. 17 is a sketch of the split-ring illustrating the shunt fields across the base of the tube.
Figure 16:
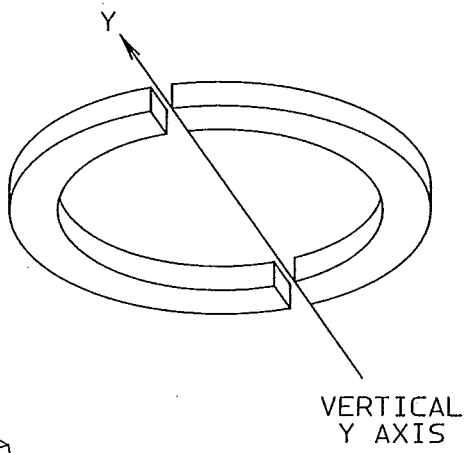
FIG. 16 shows a preferred embodiment for color tubes in which the ring is split providing two portions.

Despite the effort to eliminate interference between the ring and main deflection field, it was found that the presence of the solid ring moves the center of deflection of the vertical deflection field slightly back toward the electron gun. This is not noticeable in the monochrome system, however, it causes about $10^{-6}$ meter mis-registration in a color system and that is detectable. This problem is fixed with a split ring, configuration FIG. 16. Here, part of the induced dipole field as shown in FIG. 17 which is normally conducted by the ring is forced to enter the bore, and to join and strengthen the vertical deflection field, thereby causing the center of deflection to move forward. In practice, it was found that 2 mm air-gap can compensate $10^{-6}$ meter mis-registration.

In actual prototype experiment, in conjunction with an ITC manufactured by Matsushita Company having a serial number of M34JDJ00X1, a ferrite ring of ordinary linear ferrite was provided, having a $\mu$ of approximately 1,000–3,000 and a volume of resistivity of greater than 1 meg ohm per cc, ring dimensions of: an inner dimension of $4\frac{3}{8}''$, a width of $\frac{3}{8}''$, and a thickness of $\frac{1}{8}''$. This ring was found to produce excellent cancellation effects when it was placed against the circumferential wire portions (end closest to the screen) of the yoke provided with this ITC with spacing resulting only from the insulation of the yoke wires.

Figure 18:
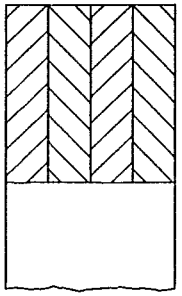
FIG. 18 is a cross-sectional diagram through a portion of a still further embodiment of ring, made with conventional $\mu$ metal laminates.

Embodiments may be made with conventional $\mu$ metal laminates, yielding rings having a cross-section as shown in FIG. 18.

Figure 19:
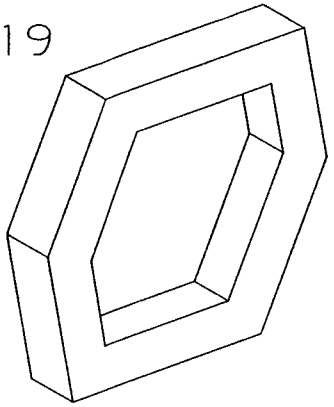
FIG. 19 shows a further embodiment, having a hexagonal shape.

Finally, FIG. 19 shows a hexagonally shaped ring, representing a still further embodiment for use with, for example, a hexagonally configured yoke.

While the invention has been described herein with respect to the preferred and various other embodiments, it will be understood by those skilled in this art that still other modifications and variations may readily be conceived by one of ordinary skill in the art to which it pertains, without departing from the spirit and scope of the invention as set forth herein. It is contemplated that all such variations, modifications and embodiments are encompassed within the scope of the appended claims.

I claim:

1. In a cathode ray tube display device having a screen for viewing, means for producing a charged particle beam directed at said screen from the rear thereof and aligned with a central axis and a deflection coil yoke having a magnetic component from axially aligned wired segments and a magnetic component from circumferentially aligned wire segments relative to said axis and ferrite core about said deflection coil, giving rise to a desired deflection field for deflecting said beam and an undesirable net distributed magnetic far field radiation outside said device which resembles a vertically oriented dipole field whose mathematical center lines on the central axis slightly ahead of the yoke, apparatus for reducing said net distributed magnetic far field radiation in front of said screen and all about said device, while minimizing the effect within said tube, comprising:

a substantially complete ring of magnetically permeable material with at most only narrow non-magnetic gaps, said ring substantially centered on said central axis totally disposed between end turns of said coil and said screen, said ring positioned near and spaced from said end turns of said coil with the thickness, internal diameter and outer diameter, permeability and separation between the coil yoke and ring being determined to minimize said undesirable net distributed magnetic far field radiation in front of said screen and all about the outside of said device while having minimum effect within the tube.

2. The apparatus according to claim 1 wherein said ring is a ring of ferrite with a permeability greater than 1,000 and spacing from the yoke determined to reduce the far field while having minimum effect within the tube.

3. The apparatus according to claim 1 wherein said coil is a saddle yoke and said ring is spaced from said yoke with no portion thereof under said yoke but all portions forward of the yoke toward said screen.

4. The apparatus according to claim 1 wherein said ring comprises multiple ferrite sections forming a ring.

5. The apparatus according to claim 1 wherein said ring comprises a pair of semi-circular ferrite sections separated by a pair of gaps of non-ferrite material.

6. The apparatus according to claim 1 wherein said ring comprises a pair of sections with the non-ferrite gaps between the sections being in the plane of the vertical deflection of said beam.

7. The apparatus according to claim 6 wherein the size of said non-ferrite gaps between said sections is determined to correct for mis-registration.

8. The apparatus according to claim 4 wherein said multiple sections are gapped to adjust for mis-registration.

9. In a color cathode ray tube display device having a cathode ray tube having three displaced beams when undeflected extending generally along the central axis of the tube, a tri-color phosphor screen in which the color emitted is dependent upon the angle of approach of a cathode ray beam, magnetic deflecting means about the narrow neck of said tube arranged to cause said beam to scan and screen, said deflection means including yoke with horizontal and vertical deflection coils and a core wherein said deflection coils have end turns extending toward said screen, said horizontal coils giving rise to undesirable net magnetic field radiation outside of said device which resembles a vertically oriented dipole field whose mathematical center lies on the central axis slightly ahead of the yoke, apparatus for reducing said net magnetic far field radiation in front of said screen and all about said device, while minimizing the effect in said central axis and within said tube comprising:

a pair of generally semi-circular bodies of magnetically permeable material spaced by a pair of narrow gaps to form a ring;

said ring being disposed between the end turns of said coil and screen, said gaps being along the plane of the vertical deflection; and said ring being disposed near said end turns of said horizontal coil, said gap size being determined to adjust for mis-registration of said three beams on said tri-color phosphors.

10. The apparatus according to claim 9 wherein said gaps between said bodies are adjusted to correct for mis-registrations.

11. The apparatus according to claim 10 wherein said gaps between said bodies are about 2 millimeters.

* * * * *